US006659833B1

(12) United States Patent
Sloot

(10) Patent No.: US 6,659,833 B1
(45) Date of Patent: Dec. 9, 2003

(54) BEVERAGE CAN CAP AND NOVELTY ITEM

(75) Inventor: Alexander Sloot, Sugarloaf, PA (US)

(73) Assignee: Printmark Industries, Icn., Hazelton, PA (US)

( * ) Notice: Subject to any disclaimer, the term of this patent is extended or adjusted under 35 U.S.C. 154(b) by 0 days.

(21) Appl. No.: 10/222,628

(22) Filed: Aug. 16, 2002

(51) Int. Cl.[7] ..... B65D 51/22
(52) U.S. Cl. ..... 446/71; 220/258.2
(58) Field of Search ..... 220/258.1, 258.2, 220/258.3, 906; 446/71, 77, 79; 206/459.5, 457

(56) References Cited

U.S. PATENT DOCUMENTS 5,139,163 A 8/1992 Diaz
5,221,020 A 6/1993 Brimo, II
5,273,176 A 12/1993 Diaz
5,346,088 A 9/1994 Brimo, II
5,452,818 A 9/1995 Yost
5,647,497 A 7/1997 Labbe
5,996,832 A 12/1999 Nieuwoudt
6,098,830 A * 8/2000 Jamieson ..... 220/259.1
6,296,137 B1 10/2001 Bjernsen
6,378,718 B1 * 4/2002 Maggi et al. ..... 220/257.1

* cited by examiner

*Primary Examiner*—Jacob K. Ackun
(74) *Attorney, Agent, or Firm*—St. Onge Steward Johnston & Reens, LLC

(57) ABSTRACT

A beverage can cap for attachment to a beverage can having a top wall surrounded by a peripheral and circular lip and a tab opener attached to the top wall is provided. The beverage can cap includes an upper layer sized and shaped to fit within the peripheral and circular lip of the beverage can, the upper layer having a substantially circular periphery, and a lower layer having an arc-shaped outer periphery which corresponds to a portion of the substantially circular periphery of the upper layer. A pocket is defined by the upper layer and the lower layer, which pocket is adapted to receive the tab opener of the beverage can when the beverage can cap is installed on the can and the lower layer is disposed between the tab opener and the top wall of the beverage can.

37 Claims, 4 Drawing Sheets

BEVERAGE CAN CAP AND NOVELTY ITEM

FIELD OF THE INVENTION

The present invention relates to a cap for beverage cans, and more particularly to a beverage can cap that will have a decorative and/or promotional use, and also for inhibiting dirt, dust and debris from collecting on the top of the can during storage and inhibiting access to the can, once opened, by insects or debris, and which is adapted to be used as a novelty item in a number of ways.

BACKGROUND OF THE INVENTION

As is well known, beverages such as beer, soda, iced teas, juices and the like are regularly dispensed in poptop cans made from aluminum and/or similar materials. Access to the container is achieved by a top adapted to be punctured by a tab affixed to the top. Sometimes, only part of the contents are served at one time and it is desirable to protect the remaining contents in the can. Unfortunately, conventional cans provide no mechanism to close the opening once it is established. Accordingly, opened cans are prone to a variety of problems, including loss of carbonation, spillage, and access by insects or debris. Conventional cans also provide no mechanism for inhibiting dirt, dust and debris from collecting on the top of the can during storage so as to promote a clean area surrounding the can opening.

As a result of these deficiencies, a number of various caps have been proposed to contain and/or preserve the contents of a beverage can and/or to keep the top of the can clean during storage. Although some of these existing caps may function adequately well for certain limited purposes, none is believed to be fully satisfactory.

A number of reusable beverage can enclosures have been proposed which are designed to seal the top of a beverage can in an airtight manner after it has been opened in order to inhibit a carbonated beverage contained therein from losing its carbonation. Examples of such enclosures can be found in U.S. Pat. Nos. 5,221,020, 5,346,088 and 5,452,818. However, while such enclosures may provide adequate where the object is to inhibit a beverage from losing its carbonation, when one is not concerned with such a loss of carbonation, such enclosures are highly inefficient. This is the case because in order to create an air-tight seal, the enclosures must have a relatively complex design and must be formed from heavy gauge materials in order to tightly engage the outer rim of the beverage can to create an air-tight seal even under pressure created by the carbonated beverage. If one is not concerned with inhibiting the loss of carbonation, a simpler design using lighter weight materials would be far more desirable.

Other beverage can enclosures have been proposed which are designed to have two portions, one which permanently attaches to the beverage can itself and the other which comprises a cover portion connected thereto by a hinged connection such that the cover portion can be flipped open and be reclosed. U.S. Pat. Nos. 5,139,163 and 5,273,176 disclose such reclosable beverage can enclosures. While such enclosures are not necessarily concerned with inhibiting a loss of carbonation, these enclosures suffer from disadvantages similar to those enclosures which are so concerned. This is true because the portions of such reclosable enclosures which are permanently attached to the can must be designed, like those enclosures designed to inhibit loss of carbonation, to securely engage the outer rim of the beverage can. As such, these reclosable enclosures also disadvantageously must have a relatively complex design and must be formed from heavy gauge materials.

U.S. Pat. No. 5,647,497 discloses a protective removable cover for beverage containers. The cover comprises a piece of sheet material covering at least a major portion of the top of the beverage container which includes an adhesive strip surrounding the periphery of the sheet material. Before the beverage container is opened, the protective cover is peeled off. However, a major disadvantage of this type of cover is that it is designed only to protect the top of the beverage container until the container is opened, and once the protective cover has been removed, it is not replaceable to protect the opened container from access by insects or debris.

U.S. Pat. No. 5,996,832 discloses a cover for a beverage can which is sized and shaped to tightly engage the inner surface of the rim of the beverage can (see FIGS. 15–20 thereof). This design, however, suffers from a number of disadvantages of its own. In order to achieve proper retention on the top of the can, relatively tight tolerances must be maintained, which may greatly increase the cost of production. In addition, the precise dimensions of the inner surface of the can's rim may vary from one manufacturer to another. As such, the cover may not be usable with cans produced by substantially all manufacturers. Moreover, even if tight tolerances are maintained and even if the covers are used with appropriate cans, the cover may not be securely maintained on the can, and may easily fall off prematurely.

U.S. Pat. No. 6,296,137 discloses a similar beverage can cover which additionally includes two diagonally arranged, backwardly slanting, opposing fixing flaps which are designed such that when the cover is pressed down towards the can top, the flaps are bent in the direction of the front face of the cover, whereby the fixing flaps come into engagement between the top surface of the can and the pull tab of the can. However, as best seen in FIG. 2 of the '137 patent, the flexible flaps are retained only under a small portion of the pull tab of the can. As such, the cover may not be securely maintained on the can, and may easily fall off prematurely. Also, once the cover is removed, it may be difficult for the user to reinstall the cover on the can.

In addition to the individual disadvantages discussed above with respect to each of the known beverage container caps, all of them suffer from at least one additional common disadvantage. With respect to the reusable container caps, while they may be used over and over as container caps, they serve substantially no other purpose. With respect to the single use container caps, once they are removed from the container, the are essentially useless. It would be far more desirable and less wasteful in some cases if the beverage container caps were adapted to be used as a novelty item, such as a promotional piece, decorative cover, toy or safety device, in some way.

What is desired, therefore, is a beverage can cap which inhibits dirt, dust and debris from collecting on the top of the can during storage and inhibits access to the can, once opened, by insects or debris, which is easily and inexpensively printable and able to be decorated in full color printing if desired, which may be formed from lightweight materials, is relatively simple in design, and thus relatively inexpensive to produce, which does not require that relatively tight tolerances be maintained, which is usable with cans produced by substantially all manufacturers, which is securely maintained on the can and does not easily fall off prematurely, which is easily replaceable after initial removal, and which is adapted to be used as a novelty item in some way.

SUMMARY OF THE INVENTION

Accordingly, it is an object of the present invention to provide a beverage can cap which inhibits dirt, dust and debris from collecting on the top of the can during storage and inhibits access to the can, once opened, by insects or debris.

Another object of the present invention is to provide a beverage can cap having the above characteristics and which may be formed from lightweight materials, is relatively simple in design, and thus relatively inexpensive to produce.

A further object of the present invention is to provide a beverage can cap having the above characteristics and which does not require that relatively tight tolerances be maintained.

Still another object of the present invention is to provide a beverage can cap having the above characteristics and which is usable with cans produced by substantially all manufacturers.

Yet a further object of the present invention is to provide a beverage can cap having the above characteristics and which is securely maintained on the can and does not easily fall off prematurely.

Still yet another object of the present invention is to provide a beverage can cap having the above characteristics and which is easily replaceable after initial removal.

Yet another object of the present invention is to provide a beverage can cap having the above characteristics and which is adapted to be used as a novelty item in at least one, and preferably many, ways.

Still a further object of the present invention is to provide a beverage can cap having the above characteristics and which is easily manufactured and easily printed in bright decorative colors, and/or printed with promotional logos.

Yet still another object of the present invention is to provide a beverage can cap having the above characteristics and which when applied to the top of the can, will be so shaped that it does not interfere with the stackability of the can when such cans are stacked on top of each other.

These and other objects of the present invention are achieved by provision of a beverage can cap for attachment to a beverage can having a top wall surrounded by a peripheral and circular lip and a tab opener attached to the top wall. The beverage can cap includes an upper layer sized and shaped to fit within the peripheral and circular lip of the beverage can, the upper layer having a substantially circular periphery, and a lower layer having an arc-shaped outer periphery which corresponds to a portion of the substantially circular periphery of the upper layer. A pocket is defined by the upper layer and the lower layer, which pocket is adapted to receive the tab opener of the beverage can when the beverage can cap is installed on the can and the lower layer is disposed between the tab opener and the top wall of the beverage can.

In one embodiment, the periphery of the lower layer is bonded to the periphery of the upper layer along a continuous seal which passes through at least 180 continuous degrees of the circle defined by the substantially circular periphery of the upper layer. In this embodiment, it is preferable that the lower layer is sized and shaped so as to cover at least half of, and possibly up to approximately three-quarters of, the circle defined by the substantially circular periphery of the upper layer. Most preferably, the lower layer is semi-circular in shape In another embodiment, an intermediate layer is sandwiched between the upper layer and the lower layer, the intermediate layer being provided with stamped weakened portions which are adapted to be manipulated by a user to create at least one mechanism for adapting the beverage can cap to be used as a novelty item. In this embodiment, it is preferable that the upper layer and the intermediate layer are continuously sealed about their respective peripheries so as to trap a pocket of air therebetween. The at least one mechanism for adapting the beverage can cap to be used as a novelty item may comprises a pencil slot such that the beverage can cap may be used as a decorative pencil topper, a zipper pull attachment mechanism, a shoelace attachment mechanism, a button hole, or combinations of these. Most preferably, the lower layer is removable so as not to interfere with use of the at least one mechanism.

Preferably, each of the layers are formed from vinyl or other thermoplastic sheet material, and the upper layer and the intermediate layer (if provided) are formed to have a domed or slightly raised configuration. It is preferable if the upper layer is formed from a material which is reflective, glow-in-the-dark, lenticular, has glittering properties, or has combinations thereof. It is also preferable that the upper layer has lettering and/or graphics printed thereon. A pressure sensitive adhesive layer may be applied to the lower layer with a removable backing layer covering the pressure sensitive adhesive layer.

The invention and its particular features and advantages will become more apparent from the following detailed description considered with reference to the accompanying drawings.

DETAILED DESCRIPTION OF AN EMBODIMENT OF THE INVENTION

Figure 1:
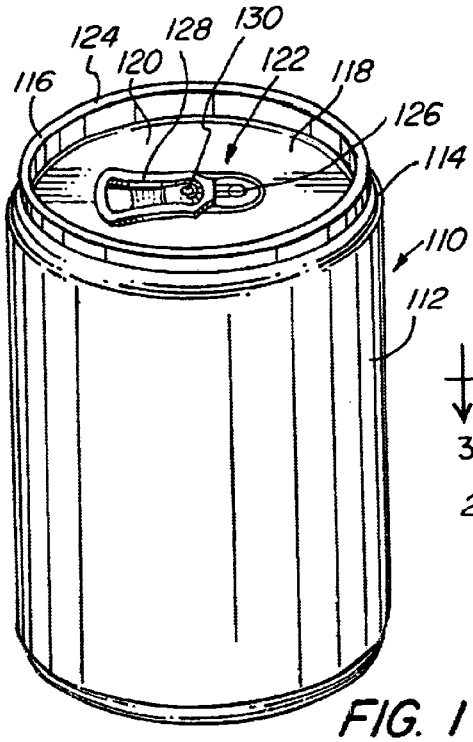
FIG. 1 (PRIOR ART)
FIG. 1 is an isometric view of a beverage can in conjunction with which a beverage can cap in accordance with the present invention is designed to be used.
Figure 2:
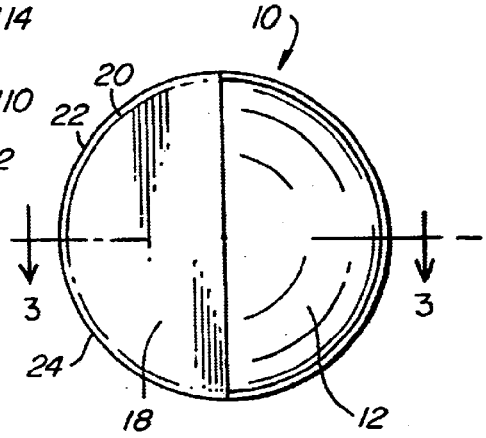
FIG. 2 is a rear plan view of a first embodiment a beverage can cap in accordance with the present invention.

Referring first to FIG. 1, a beverage can 110 comprises a bottom wall (not shown), and a generally cylindrical and vertical sidewall 112 formed with a generally tapered upper portion 114. Upper portion 114 is folded up to define a peripheral circular top end 116. The beverage can 110 finally comprises a top wall 118 having a top outer surface 120, an opening means 122 and an upwardly extending peripheral and circular lip 124 defining a top circular edge surface.

Opening means 122 comprises a partially stamped portion 126 of the top wall 118. A tab opener 128 is connected to the top wall 118 outside the partially stamped top wall portion 126 by means of a rivet 130. To open the beverage can 110, the tab opener 128 is lifted and, therefore, pivots about the rivet 130 to push the partially stamped portion 126 into the beverage can 110. The stamped portion 126 remains attached to the top wall 118 through a non stamped tongue (not shown) interconnecting the top wall 118 with the partially stamped portion 126. This type of construction is well known to those of ordinary skill in the art and accordingly will not be further described in the present disclosure.

A first embodiment of the beverage can cap 10 in accordance with the present invention is illustrated in FIGS. 2–5. Beverage can cap 10 includes an upper layer 12 which is sized and shaped to fit within upwardly extending peripheral and circular lip 124 of a beverage can 110. Typically, upper layer 12 is substantially circular and approximately two inches in diameter, although the precise shape and size thereof will of course vary depending upon the size and shape of lip 124 of can 110. It should be noted that positional references such as "top," "bottom," "upper," "lower," etc. refer to a beverage can 110 which is standing upright as shown in FIG. 1, and to a beverage can cap 10 which is installed on a beverage can in this position.

Figure 3:
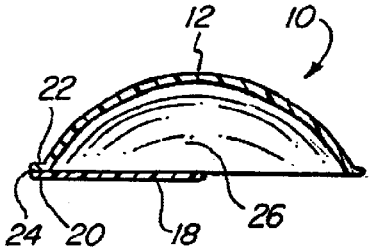
FIG. 3 is a side cross-sectional view of the beverage can cap taken along line 3—3 of FIG. 2.
Figure 5:
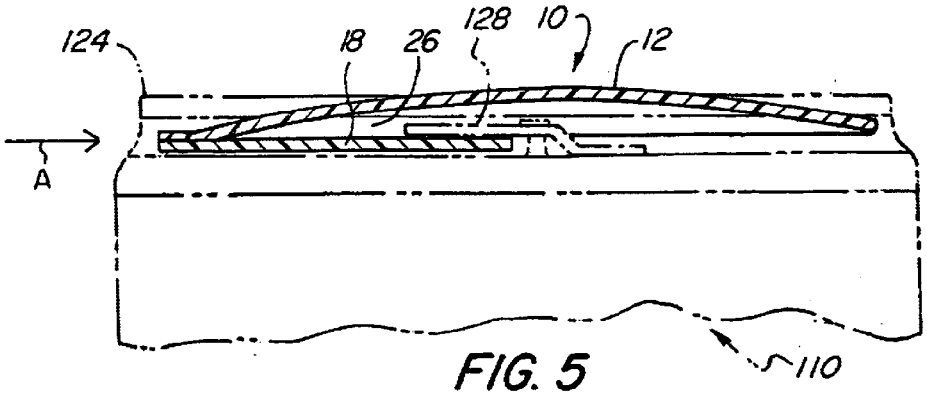
FIG. 5 is a side partially cross-sectional view of the beverage can cap of FIG. 2 shown installed on a beverage can.

Upper layer 12 is formed of some type of sheet material, preferably a vinyl or other thermoplastic sheet material. Preferably, upper layer 12 is formed to have a domed or slightly raised configuration, as best seen in FIGS. 3 and 5. This is most preferably accomplished by vacuum forming, but may also be accomplished by injection molding, blow molding or some other molding process. This allows cap to be highly visible and aesthetically pleasing while not interfering with two or more beverage cans 110 being stacked on top of each other. The underside of a standard can is domed, and the beverage can cap is so designed as to be adequately accommodated within the concave underside of a standard beverage can.

Figure 14A:
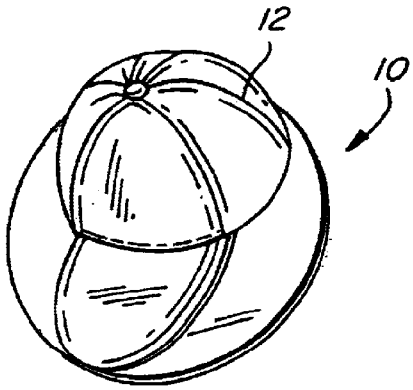
FIGS. 14A and 14B are top isometric views of beverage can caps similar to those of FIG. 2, FIG. 7, or FIG. 9 shown with the upper layer having a design specific shape rather than being dome-shaped.
Figure 14B:
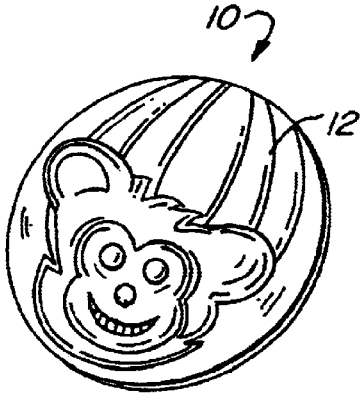

In addition, this domed or slightly raised configuration may also be design specific, in that the shape may be made to conform to the graphics printed on its surface. For example, with respect to FIG. 14A, if there was a design of a baseball cap printed on upper layer 12, upper layer 12 may be shaped to have a raised portion which mimics a baseball cap. Similarly, with respect to FIG. 14B, if there was a design of an animal face printed on upper layer 12, upper layer 12 may be shaped with protruding ears, a recessed mouth, etc. corresponding to the face.

Upper layer 12 may be transparent, translucent, or opaque and may be colored or not. Upper layer 12 may also be plain, reflective, glow-in-the-dark, lenticular, have glittering properties, have combinations of these properties or have other interesting features. Upper layer 12 may have lettering 14, such as advertising information and/or logos, and/or graphics 16 printed thereon. If printed, such may be easily accomplished by either printing directly onto the material forming upper layer 12 or by printing on a first film layer that is laminated to a second layer in order to form upper layer 12 before upper layer 12 is formed into a unit preferably having a domed or slightly raised configuration.

Beverage can cap 10 also includes a lower layer 18 attached to upper layer 12. Lower layer 18 is has an arc-shaped outer periphery 20 along its edge which corresponds to a portion of the circular outer periphery 22 along an edge of upper layer 12. Lower layer 18 is bonded to upper layer 12 along a continuous seal 24 along these mating peripheries 20,22. Lower layer 18, like upper layer 12, is formed of some type of sheet material, preferably a vinyl or other thermoplastic sheet material, with upper layer 12 and lower layer 18 being bonded together along continuous seal 24, for example, by radio frequency sealing, heat sealing, ultrasonic welding, or any of numerous other known gluing, adhesive, or sealing methods.

Lower layer 18 is sized so as to cover at least half of the circle defined by circular outer periphery 22 of upper layer 12. Thus, lower layer 18 may be semicircular (as shown in the Figures), or may have an area greater than half of the circle. Stated another way, the arc-shaped outer periphery 20 of lower layer 18 passes through at least 180 continuous degrees of the circle defined by circular outer periphery 22 of upper layer 12. It should also be noted that the arc-shaped outer periphery 20 of lower layer 18 is sealed to circular outer periphery 22 of upper layer 12 along continuous seal 24 which extends along the entire length of arc-shaped outer periphery 20 of lower layer 18 (which as stated above passes through at least 180 continuous degrees of the circle defined by circular outer periphery 22 of upper layer 12). Such is important so that upper layer 12 and lower layer 18 define a structured pocket 26 therebetween, rather than permitting lower layer 18 to simply flexibly pivot with respect to upper layer 12.

Figure 4:
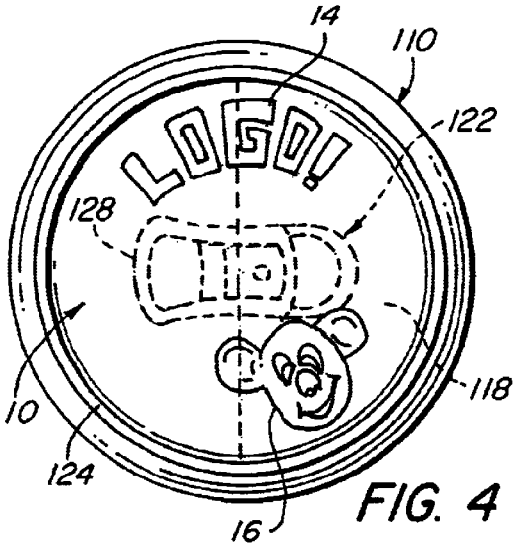
FIG. 4 is a top plan view of the beverage can cap of FIG. 2 shown installed on a beverage can.

As stated above and referring particularly to FIGS. 4 and 5, beverage can cap 10 is sized and shaped to fit within upwardly extending peripheral and circular lip 124 of a beverage can 110. However, beverage can cap 10 is not simply pressed onto can 110 from above. Instead, beverage can cap is placed on can 110 such that lower layer 18 fits under tab opener 128 (best seen in FIG. 5), and then beverage can cap 10 is slid horizontally (indicated by arrow A) such that lower layer 18 is engaged between tab opener 128 and top wall 118 of can 110 with tab opener 128 fitting within pocket 26 defined by upper layer 12 and lower layer 18. In this manner, beverage can cap 10 is securely held onto can 110 so as to inhibit dirt, dust and debris from collecting on the top of the can during storage yet may be easily removed by the user before opening can 110. Beverage can cap 10 may also be quickly and easily reinstalled on can 110 after opening so as to inhibit access to the can, once opened, by insects or debris.

It is also desirable that beverage can cap 10 be adapted to be used as a novelty item, particularly when upper layer 12 is provided with some interesting visual feature and/or advertising graphic or logo. For example, beverage can cap 10 may be adapted to be used as an entertainment item and/or a safety device (which is particularly the case when upper layer 12 is formed from a retroreflective and/or glow-in-the-dark material). FIGS. 6–13 illustrate embodiments of beverage can cap 10 specially adapted for such purposes.

Figure 6:
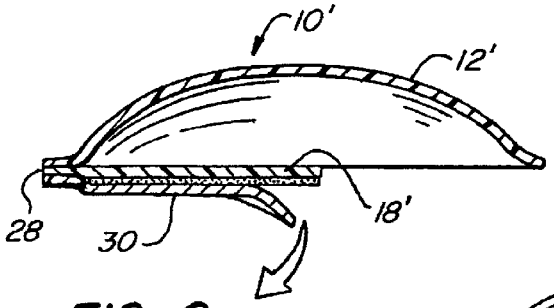
FIG. 6 is a side cross-sectional view of a second embodiment of a beverage can cap in accordance with the present invention.
Figure 7:
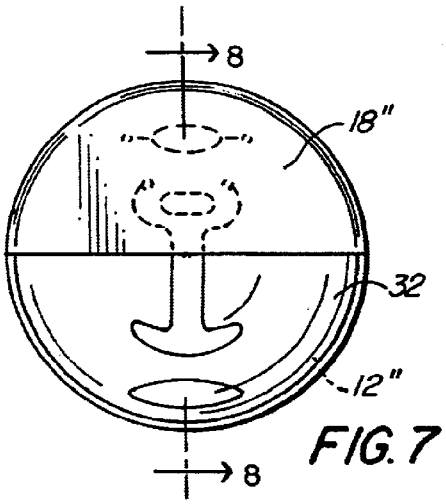
FIG. 7 is a rear plan view of a third embodiment a beverage can cap in accordance with the present invention.
Figure 8:
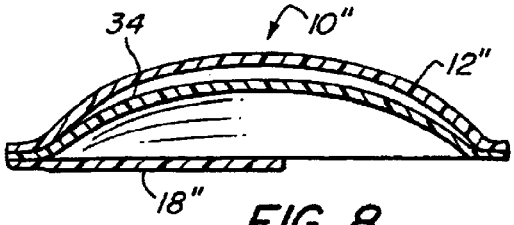
FIG. 8 is a side cross-sectional view of the beverage can cap taken along line 8—8 of FIG. 7.

Referring first to FIG. 6, a beverage can cap 10' formed of an upper layer 12' and a lower layer 18' having a configuration nearly identical to the configuration of beverage can cap 10 described above is shown. The difference between beverage can cap 10' and beverage can cap 10 is that lower layer 18' of beverage can cap 10' is provided with a pressure sensitive adhesive layer 28 which is covered by a removable backing layer 30. It is intended that backing layer 30 remain in place covering adhesive layer 28 while beverage can cap 10' is being used in conjunction with protecting can 110. Therefore, adhesive layer 28 plays no part in retaining beverage can cap 10' in place on beverage can 110. It is only after beverage can cap 10' is no longer to be used to protect can 110 that backing layer is removed so that beverage can cap 10' may now be used as a "sticker" and be adhered to books, windows, clothing, or any other object on which the user desires. Two beverage can caps 10' may also be adhered to one another back-to-back with objects therebetween. For example, two beverage can caps 10' may be adhered to each other around the spokes of a bicycle wheel, which is particularly desirable to create a two-sided bicycle wheel reflector when upper layer 12' of beverage can cap 10' is formed from a retroreflective material. Similarly, two beverage can caps 10' may be adhered to each other around the antenna of an automobile to create a two-sided automobile antenna reflector. Numerous other uses for such a "sticker" should be obvious to those skilled in the art.

Lower layer 18 (plain lower layer) and/or lower layer 18' (lower layer having pressure sensitive adhesive applied thereto) may also be made of a flexible magnetic material, to which the upper layer 12, 12' may be directly sealed. The purpose of the magnetic material is not to make the can cap 10, 10' adhere to the top of the can (it cannot, because typical cans are not magnetic receptive), but so that the can cap may have a secondary use as a promotional or decorative magnet which may be applied to a refrigerator or the like.

Referring now to FIGS. 7–13, a beverage can cap 10" formed of an upper layer 12" and a lower layer 18" having a configuration nearly identical to the configuration of beverage can cap 10 described above is shown. However, beverage can cap 10" in accordance with this embodiment of the invention also includes an intermediate layer 32, which like upper layer 12" is preferably domeshaped or otherwise raised. Like lower layer 18" and upper layer 12", intermediate layer 32 is formed of some type of sheet material, preferably a vinyl or other thermoplastic sheet material. Intermediate layer 32 is bonded with upper layer 12" around the peripheries thereof, for example, by radio frequency sealing, heat sealing, ultrasonic welding, or any of numerous other known gluing, adhesive, or sealing methods. Lower layer 18" is then bonded to intermediate layer 32 rather than directly to upper layer 12".

Because intermediate layer 32 and upper layer 12" are bonded around the peripheries thereof, they form a pocket 34 of air therebetween which may aid in providing structural stability to upper layer 12" so that it better maintains its domed or raised shape. However, the main purpose of intermediate layer 32 is to provide one or more mechanisms for adapting beverage can cap 10" to be used as a novelty item. Such mechanisms, which are more fully described below, may be stamped in intermediate layer 32 such that weakened portions are provided, which weakened portions may be manipulated by the end user and thereby utilized. In order to more easily utilize these mechanisms, lower layer 18" may be torn off from its connection with intermediate layer 32, as shown in FIG. 9.

Figure 9:
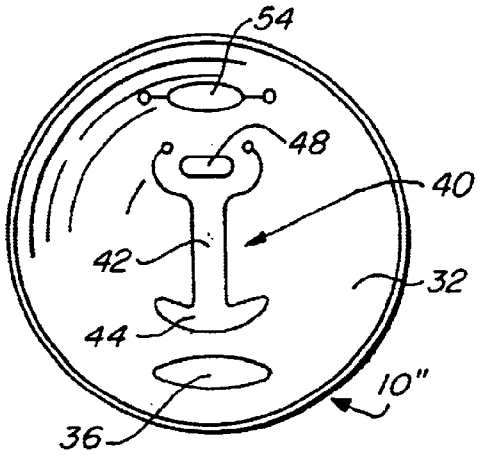
FIG. 9 is a rear plan view of the beverage can cap of FIG. 7 shown with a portion thereof having been removed.
Figure 11:
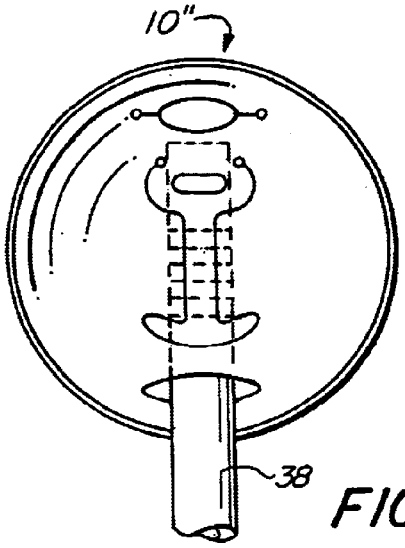
FIG. 11 is a rear plan view of the beverage can cap of FIG. 9 shown being used as a pencil or pen topper.

Referring particularly to FIG. 9, one such mechanism is a pencil slot 36 sized and shaped to receive a pencil 38, pen or the like such that beverage can cap 10" may be used as a decorative pencil topper (see FIG. 11). Pencil slot 36 may be created by removing a weakened portion of intermediate layer 32 which is provided for this purpose. It should be noted that depending upon the position of pencil slot 36, it may not be necessary to remove lower layer 18". This being the case, and if lower layer 18" is provided with a pressure sensitive adhesive as described above with respect to lower layer 18', once beverage can cap 10" were attached to a pencil, pen or the like, two beverage can caps 10" may be adhered back-to-back to create a double sided pencil topper.

Figure 12:
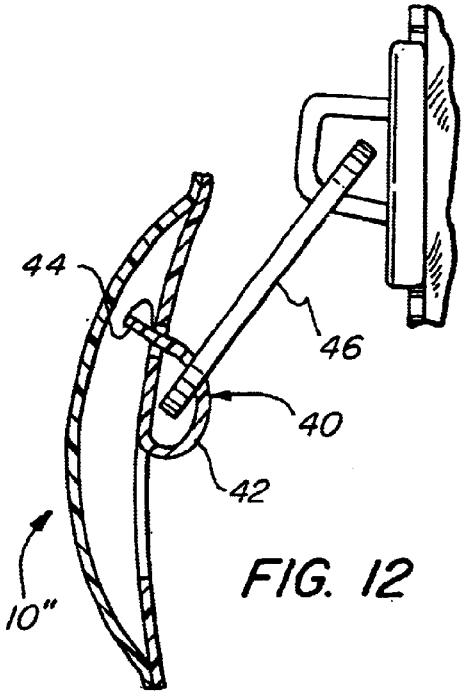
FIG. 12 is a side partially cross-sectional view of the beverage can cap of FIG. 9 shown being used as a zipper pull.

Another mechanism for adapting beverage can cap 10" to be used as a novelty item which may be provided is a zipper pull attachment mechanism 40, which may be formed from an elongated member 42 having a widened head portion 44 adapted to be passed through the zipper pull 46 of a zipper and then through a slot 48 in intermediate layer 32 and be retained therein (see FIG. 12). Zipper pull attachment mechanism 40 may be created by fracturing and/or removing weakened portions of intermediate layer 32 which are provided for this purpose.

Figure 10:
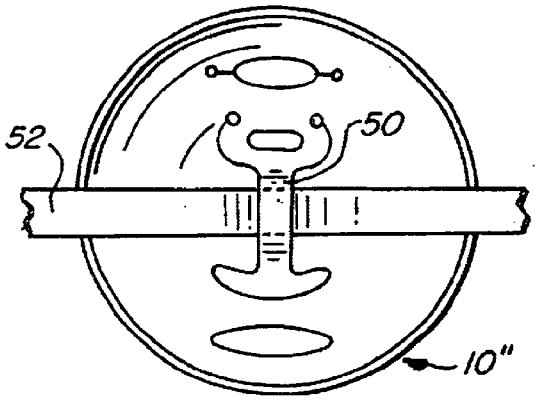
FIG. 10 is a rear plan view of the beverage can cap of FIG. 9 shown being attached to a shoe lace.

By fracturing only the portion of zipper pull attachment mechanism 40 surrounding elongated member 42, but not widened head portion 44, a shoelace attachment mechanism 50 may be provided which is adapted to have a shoelace 52 threaded therethrough such that beverage can cap 10" may be applied to a shoe or sneaker (see FIG. 10). In either case, if beverage can cap 10" is made of a reflective material, then the user is able to benefit from a personal safety product.

Figure 13:
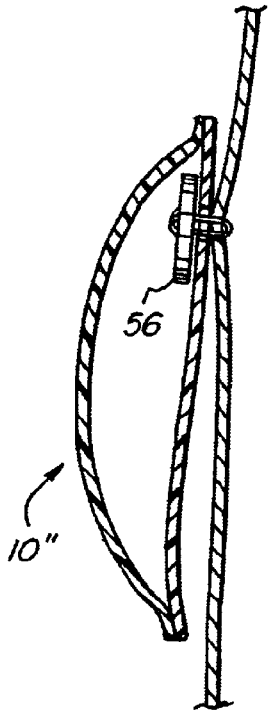
FIG. 13 is a side partially cross-sectional view of the beverage can cap of FIG. 9 shown being attached to the button of a garment.

Yet another mechanism for adapting beverage can cap 10" to be used as a novelty item which may be provided is a button hole 54 sized and shaped to receive a button 56 of a shirt or the like such that beverage can cap 10" may be worn on a garment (see FIG. 13). Button hole 54 may be created by removing a weakened portion of intermediate layer 32 which is provided for this purpose.

It should be understood by those skilled in the art that other mechanisms for adapting beverage can cap 10" to be used as a novelty item may also be provided. It should also be understood that beverage can cap 10" may also include pressure sensitive adhesive and backing layers on lower layer 18" so that beverage can cap 10" can be used as a sticker similar to beverage can cap 10'.

Instructions for the various novelty uses of beverage can caps 10, 10' and 10" may be provided on the back of lower layer 12, 12', 12", on the back of intermediate layer 32 (when provided) and/or on the back of backing layer 30 (when provided).

The present invention, therefore, provides a beverage can cap which inhibits dirt, dust and debris from collecting on the top of the can during storage and inhibits access to the can, once opened, by insects or debris, which is easily and inexpensively printable and able to be decorated in full color printing if desired, which may be formed from lightweight materials, is relatively simple in design, and thus relatively inexpensive to produce, which does not require that relatively tight tolerances be maintained, which is usable with cans produced by substantially all manufacturers, which is securely maintained on the can and does not easily fall off prematurely, which is easily replaceable after initial removal, and which is adapted to be used as a novelty item in some way.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A beverage can cap for attachment to a beverage can having a top wall surrounded by a peripheral and circular lip and a tab opener attached to the top wall, said beverage can cap comprising:

an upper layer sized and shaped to fit within the peripheral and circular lip of the beverage can, said upper layer having a substantially circular periphery;

a lower layer having an arc-shaped outer periphery which corresponds to a portion of the substantially circular periphery of said upper layer, the periphery of said lower layer being bonded to the periphery of said upper layer along a continuous seal which passes through at least 180 continuous degrees of the circle defined by the substantially circular periphery of said upper layer;

a pocket defined by said upper layer and said lower layer; and wherein said pocket is adapted to receive the tab opener of the beverage can when said beverage can cap is installed on the can and said lower layer is disposed between the tab opener and the top wall of the beverage can.

2. The beverage can cap of claim 1 wherein said upper layer and said lower layer are formed from vinyl or other thermoplastic sheet material.

3. The beverage can cap of claim 1 wherein said upper layer is formed to have a domed or slightly raised configuration.

4. The beverage can cap of claim 1 wherein said upper layer is formed from a material which is reflective, glow-in-the-dark, lenticular, has glittering properties, or has combinations thereof.

5. The beverage can cap of claim 1 wherein said upper layer has lettering and/or graphics printed thereon.

6. The beverage can cap of claim 5 wherein said upper layer is formed to have a shape which conforms to the lettering and/or graphics printed thereon.

7. The beverage can cap of claim 1 wherein said lower layer is sized and shaped so as to cover at least half of the circle defined by the substantially circular periphery of said upper layer.

8. The beverage can cap of claim 1 wherein said lower layer is semi-circular in shape.

9. The beverage can cap of claim 1 further comprising a pressure sensitive adhesive layer applied to said lower layer and a removable backing layer covering said pressure sensitive adhesive layer.

10. The beverage can cap of claim 1 wherein said lower layer is formed from a flexible magnetic material.

11. The beverage can cap of claim 1 further comprising an intermediate layer sandwiched between said upper layer and said lower layer.

12. The beverage can cap of claim 11 wherein said upper layer, said intermediate layer and said lower layer are formed from vinyl or other thermoplastic sheet material.

13. The beverage can cap of claim 11 wherein said upper layer and said intermediate layer are formed to have a domed or slightly raised configuration.

14. The beverage can cap of claim 13 wherein said upper layer and said intermediate layer are continuously sealed about their respective peripheries so as to trap a pocket of air therebetween.

15. The beverage can cap of claim 11 wherein said intermediate layer is provided with stamped weakened portions which are adapted to be manipulated by a user to create at least one mechanism for adapting said beverage can cap to be used as a novelty item.

16. The beverage can cap of claim 15 wherein the at least one mechanism for adapting said beverage can cap to be used as a novelty item comprises a pencil slot such that said beverage can cap may be used as a decorative pencil topper.

17. The beverage can cap of claim 15 wherein the at least one mechanism for adapting said beverage can cap to be used as a novelty item comprises a zipper pull attachment mechanism.

18. The beverage can cap of claim 15 wherein the at least one mechanism for adapting said beverage can cap to be used as a novelty item comprises a shoelace attachment mechanism.

19. The beverage can cap of claim 15 wherein the at least one mechanism for adapting said beverage can cap to be used as a novelty item comprises a button hole.

20. The beverage can cap of claim 11 wherein said lower layer is removable.

21. A beverage can cap for attachment to a beverage can having a top wall surrounded by a peripheral and circular lip and a tab opener attached to the top wall, said beverage can cap comprising:

an upper layer sized and shaped to fit within the peripheral and circular lip of the beverage can, said upper layer having a substantially circular periphery;

an intermediate layer having a substantially circular periphery bonded to the substantially circular periphery of said upper layer, said intermediate layer being provided with stamped weakened portions which are adapted to be manipulated by a user to create at least one mechanism for adapting said beverage can cap to be used as a novelty item;

a lower layer having an arc-shaped outer periphery which corresponds to a portion of the substantially circular periphery of said intermediate layer, the periphery of said lower layer being bonded to the periphery of said intermediate layer;

a pocket defined by said intermediate layer and said lower layer; and wherein said pocket is adapted to receive the tab opener of the beverage can when said beverage can cap is installed on the can and said lower layer is disposed between the tab opener and the top wall of the beverage can.

22. The beverage can cap of claim 21 wherein said upper layer is formed from a material which is reflective, glow-in-the-dark, lenticular, has glittering properties, or has combinations thereof.

23. The beverage can cap of claim 21 wherein said upper layer has lettering and/or graphics printed thereon.

24. The beverage can cap of claim 23 wherein said upper layer is formed to have a shape which conforms to the lettering and/or graphics printed thereon.

25. The beverage can cap of claim 21 wherein said lower layer is sized and shaped so as to cover at least half of the circle defined by the substantially circular periphery of said intermediate layer.

26. The beverage can cap of claim 21 wherein said lower layer is semi-circular in shape.

27. The beverage can cap of claim 21 wherein the periphery of said lower layer is bonded to the periphery of said intermediate layer along a continuous seal which passes through at least 180 continuous degrees of the circle defined by the substantially circular periphery of said intermediate layer.

28. The beverage can cap of claim 21 further comprising a pressure sensitive adhesive layer applied to said lower layer and a removable backing layer covering said pressure sensitive adhesive layer.

29. The beverage can cap of claim 21 wherein said lower layer is formed from a flexible magnetic material.

30. The beverage can cap of claim 21 wherein said upper layer, said intermediate layer and said lower layer are formed from vinyl or other thermoplastic sheet material.

31. The beverage can cap of claim 21 wherein said upper layer and said intermediate layer are formed to have a domed or slightly raised configuration.

32. The beverage can cap of claim 31 wherein said upper layer and said intermediate layer are continuously sealed about their respective peripheries so as to trap a pocket of air therebetween.

33. The beverage can cap of claim 21 wherein the at least one mechanism for adapting said beverage can cap to be used as a novelty item comprises a pencil slot such that said beverage can cap may be used as a decorative pencil topper.

34. The beverage can cap of claim 21 wherein the at least one mechanism for adapting said beverage can cap to be used as a novelty item comprises a zipper pull attachment mechanism.

35. The beverage can cap of claim 21 wherein the at least one mechanism for adapting said beverage can cap to be used as a novelty item comprises a shoelace attachment mechanism.

36. The beverage can cap of claim 21 wherein the at least one mechanism for adapting said beverage can cap to be used as a novelty item comprises a button hole.

37. The beverage can cap of claim 21 wherein said lower layer is removable.

* * * * *